US007523693B1

(12) United States Patent
Engelhart

(10) Patent No.: US 7,523,693 B1
(45) Date of Patent: Apr. 28, 2009

(54) COMPOSITE LAMINATED ARMOR STRUCTURE

(75) Inventor: Joseph M. Engelhart, Cincinnati, OH (US)

(73) Assignee: Molding Technologies, Hebron, OH (US)

( * ) Notice: Subject to any disclaimer, the term of this patent is extended or adjusted under 35 U.S.C. 154(b) by 0 days.

(21) Appl. No.: 11/535,950

(22) Filed: Sep. 27, 2006

Related U.S. Application Data

(60) Provisional application No. 60/720,937, filed on Sep. 27, 2005.

(51) Int. Cl.
*F41H 5/02* (2006.01)
*B32B 15/08* (2006.01)

(52) U.S. Cl. ..... 89/36.02; 89/36.01; 428/626; 428/615; 109/49.5

(58) Field of Classification Search ..... 89/36.01, 89/36.02; 428/615, 626; 109/49.5
See application file for complete search history.

(56) References Cited

U.S. PATENT DOCUMENTS

| | | | | |
|---|---|---|---|---|
| 4,529,640 | A * | 7/1985 | Brown et al. | 428/116 |
| 4,702,027 | A | 10/1987 | Stanley | |
| 4,704,943 | A | 11/1987 | McDougal | |
| 5,556,695 | A | 9/1996 | Mazelsky | |
| 5,591,933 | A * | 1/1997 | Li et al. | 89/36.02 |
| 5,635,288 | A | 6/1997 | Park | |
| 5,749,140 | A * | 5/1998 | Polito et al. | 29/527.1 |
| 5,935,678 | A | 8/1999 | Park | |
| 5,972,819 | A | 10/1999 | Cohen | |
| 6,035,438 | A | 3/2000 | Neal et al. | |
| 6,203,908 | B1 | 3/2001 | Cohen | |

(Continued)

FOREIGN PATENT DOCUMENTS

BE 687116 A 3/1967

(Continued)

OTHER PUBLICATIONS

"3Tex and Second Chance to Develop Next-Generation Protective Gear for Police and Military", Jun. 14, 2001, Business Wire, http://findarticles.com/p/articles/mi_m0EIN/is_2001_June_14/ai_75522350.*

(Continued)

*Primary Examiner*—Bret Hayes
*Assistant Examiner*—Michael D David
(74) *Attorney, Agent, or Firm*—Wood, Herron & Evans, LLP

(57) ABSTRACT

The invention provides a composite laminated armor structure for absorbing and dissipating kinetic energy from a projectile fired at the armor structure. The armor structure is low in volume and weight and can resist penetration by AP ammunition. The armor structure comprises a plurality of sheets of two-dimensional woven fiberglass fabric, and a plurality of sheets of three-dimensional woven fiberglass fabric, bound with a resin matrix. According to one embodiment, the armor structure includes a back laminate section of the two-dimensional woven fiberglass fabric sheets bound with a resin matrix, a front laminate section of the two-dimensional woven fiberglass fabric sheets bound with the resin matrix, an intermediate section of the three-dimensional woven fiberglass fabric sheets bound with the resin matrix, a first metal alloy armor plate adhered to the back laminate section in opposing relation to the intermediate section, and a second metal alloy armor plate adhered to the front laminate section in opposing relation to the intermediate section.

23 Claims, 2 Drawing Sheets

U.S. PATENT DOCUMENTS

| | | | | |
|---|---|---|---|---|
| 6,327,954 | B1 * | 12/2001 | Medlin | 89/36.08 |
| 6,389,594 | B1 | 5/2002 | Yavin | |
| 6,497,966 | B2 | 12/2002 | Cohen | |
| 6,568,310 | B2 * | 5/2003 | Morgan | 89/36.02 |
| 6,745,661 | B1 | 6/2004 | Neal et al. | |
| 7,148,162 | B2 * | 12/2006 | Park et al. | 442/134 |
| 7,377,752 | B2 * | 5/2008 | Mohamed | 416/226 |
| 2003/0119398 | A1 * | 6/2003 | Bogdanovich et al. | 442/204 |
| 2003/0200861 | A1 * | 10/2003 | Cordova et al. | 89/36.02 |
| 2004/0020353 | A1 * | 2/2004 | Ravid et al. | 89/36.02 |
| 2005/0186081 | A1 * | 8/2005 | Mohamed | 416/226 |
| 2007/0189902 | A1 * | 8/2007 | Mohamed | 416/226 |
| 2007/0293107 | A1 * | 12/2007 | Follo et al. | 442/134 |
| 2007/0295198 | A1 * | 12/2007 | Booher | 89/36.02 |
| 2008/0028574 | A1 * | 2/2008 | Mack et al. | 16/385 |

FOREIGN PATENT DOCUMENTS

| | | | |
|---|---|---|---|
| EP | 122857 | A | 10/1984 |

OTHER PUBLICATIONS

European Patent Office, International Search Report and Written Opinion received in related PCT Application No. PCT/US2006/037504 dated May 30, 2008, 12 pp.

Anonymous, 3-D Woven Fiberglass Composite Reinforcement, Internet Article (Online) XP002480724, URL: http://www.3tex.com/datasheets/S2/P3W-GS019.pdf, retrieved Oct. 31, 2004, 1 pg.

* cited by examiner

COMPOSITE LAMINATED ARMOR STRUCTURE

CROSS REFERENCE TO RELATED APPLICATION

Pursuant to 37 C.F.R. § 1.78(a)(4), this application claims the benefit of and priority to prior filed co-pending Provisional Application Ser. No. 60/720,937, filed Sep. 27, 2005, which is expressly incorporated herein by reference.

FIELD OF INVENTION

This invention relates to armor structures, and more particularly, to a composite laminate structure for absorbing and dissipating kinetic energy from a projectile, such as armor piercing ammunition, fired at the structure.

BACKGROUND

Armor structures are intended to prevent penetration of projectiles into a protected area, such as a vehicle, by using protective panels. There are many possible considerations in the selection of armor structures, including weight, volume, cost, durability, ease of fabrication and ease of repair, and depending of the application in which the armor structure is to be used, one or more of these considerations may dominate. For example, in land vehicles, volume and weight may dominate, and in air vehicles, weight may dominate.

Traditionally, thick steel plates have been used for armoring vehicles. However, where weight and/or volume are of vital concern, a large volume of heavy metal is not ideal. In addition, where repetitive ammunition is likely, the armor structure needs to withstand degradation by initial projectiles such that subsequent projectiles will also be prevented from penetrating through the structure.

While there have been significant improvements made in armor structures by use of multi-layer armor, ceramic materials, and ballistic fibers, ammunition continues to increase in sophistication, thereby requiring further sophistication in armor structures. Most recently, armor piercing (AP) ammunition is a projectile of choice, particularly outside the United States. AP ammunition was designed to penetrate thinner, lightweight armor structures, thereby at least partially thwarting attempts to decrease weight, volume and cost with lighter, thinner armor structures.

There is a thus a need for low volume, low weight armor structures that resist penetration by AP ammunition and that are suitable for vehicle applications.

SUMMARY

The invention provides a composite laminated armor structure for absorbing and dissipating kinetic energy from a projectile fired at the armor structure. In one embodiment, the armor structure comprises a plurality of sheets of two-dimensional woven fiberglass fabric, and a plurality of sheets of three-dimensional woven fiberglass fabric, bound with a resin matrix. In another embodiment, the armor structure comprises a back laminate section comprising a plurality of first sheets of two-dimensional woven fiberglass fabric bound with a resin matrix; a front laminate section comprising a plurality of second sheets of two-dimensional woven fiberglass fabric bound with the resin matrix; an intermediate section interposed between the front and back laminate sections and comprising a plurality of sheets of three-dimensional woven fiberglass fabric bound with the resin matrix; a first metal alloy armor plate adhered to the back laminate section in opposing relation to the intermediate section; and a second metal alloy armor plate adhered to the front laminate section in opposing relation to the intermediate section.

BRIEF DESCRIPTION OF DRAWINGS

A more complete appreciation of the invention and many of the attendant advantages thereof will become readily apparent with reference to the following detailed description, particularly when considered in conjunction with the accompanying drawings, in which.

DETAILED DESCRIPTION

Figure 1A:
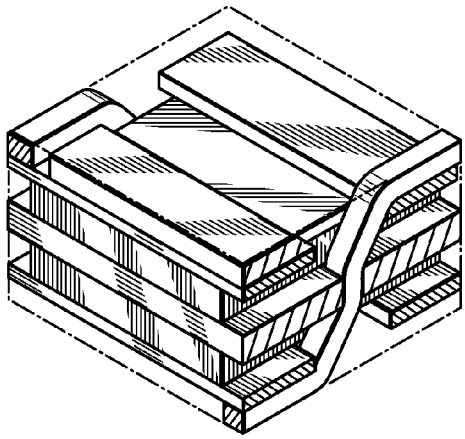
FIGS. 1A-1B depict in perspective view a three-dimensional woven fiberglass fabric used in the present invention.

This invention relates to production of a composite material capable of resisting armor piercing (AP) ammunition, such as 50 caliber AP ammunition, 30:06 AP ammunition, 30 caliber 762×51 AP ammunition, as well as smaller similar type AP rounds that produce less energy, and even ammunition as powerful as 25 mm caliber TP ammunition. The resulting technology has been tested by independent test labs and has proven to resist many types of AP ammunition. The armor structures of the present invention may also resist TP rounds of same or similar caliber. AP rounds are armor piercing rounds, whereas TP rounds are ball-round equivalents of the AP rounds. If a panel can stop an AP round, then it can stop a ball round equivalent. In many enemy-fire situations, the enemy does not possess the higher quality AP rounds, but only the ball-round equivalent. Thus, the present invention provides a composite laminate armor structure that can stop both AP and TP ammunition.

There are three primary components used in the production of a composite laminated armor structure in accordance with the invention—resin and two types of fiberglass. In another embodiment, a fourth primary component is used, namely armor plate.

In it's broadest form, the resin may be any polymer resin that is compatible with fiberglass reinforcement. A thermosetting resin may be used in certain embodiments of the invention, for example, a polyester resin. In other embodiments, a combination of a thermosetting resin and a thermoplastic resin may be used, for example a polyester and a styrene.

An example of a suitable resin is Aropol™ Q 6585 polyester resin produced by Ashland Chemical, which may be described as a high reactivity, chemically thickenable polyester resin. Another example of a suitable resin is Ashland's Aropol™ Q8000 resin, which is a styrene-based thermoplastic resin. The Q8000 resin is a low profile additive typically used in SMC (sheet molded compound) applications rather than BMC (bulk molding compounds). Composite armor is typically produced from bulk molding compounds. In one example of the invention, the Q6585 and Q8000 may be blended to form a resin matrix mixture.

The resin matrix may include additional optional additives, as desired. For example, the resin may include a mold release agent. A suitable mold release agent for use in the resin of the invention is zinc stearate, which has the formula $CH_3(CH_2)_{16}COO)_2Zn$. Zinc stearate is a commodity type non-proprietary additive readily available in the marketplace. Other metallic salts of fatty acids may be added to the resin matrix in addition to or instead of zinc stearate for mold release.

The resin mixture may also optionally include a curing agent. A suitable curing agent is SUPEROX® 46-736 (brand name from supplier Norac, Inc.). SUPEROX® is an organic peroxide curing agent. Alternatively, the curing agent may be NOROX® TBPB, which may be described as an exceptionally high purity liquid tertiary-butyl peroxybenzoate with 8.1% active oxygen used for polymerization of ethylene and styrene and for high temperature molding of polyester resin systems.

The resin mixture may also optionally include a filler component. A suitable filler is PUL-PRO® White 8-SA. PUL-PRO®, which is a brand name produced by Omya Corporation, is a limestone filler. Limestone filler is a commodity product that can be obtained from numerous sources. Other suitable fillers may be readily identified by persons skilled in the art.

The resin formulation may also include pigments, if desired. Suitable pigments may be readily identified by persons skilled in the art.

Figure 1B:
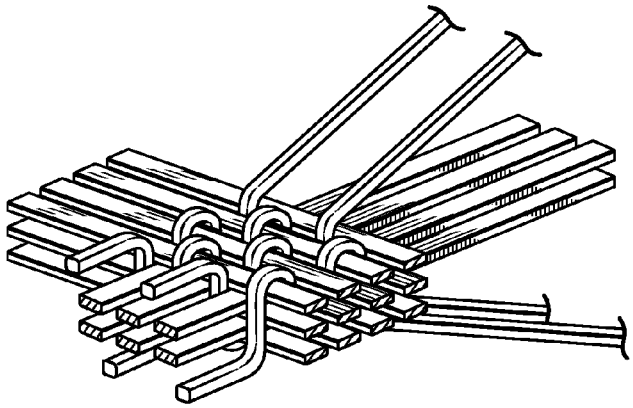

In addition to a resin matrix, composite armor of the invention is further formulated with two types of fiberglass fabric materials, namely a two-dimensional (2-D) weave and a three-dimensional (3-D) weave. The three-dimensional weave may be, for example, 50 oz 3WEAVE™ S-2 Glass woven composite reinforcement manufactured and distributed by 3Tex. This material is a continuous strand woven fiberglass fabric weaved in the x, y and z directions. In an exemplary embodiment, the fabric is essentially balanced in the x and y directions. The invention is not limited to a particular weight for the fabric; for example, 3Tex makes their S-2-glass fabric in weights ranging from 50 oz to 190 oz. E-glass or the like may also be used. For example, 3Tex makes their E-glass fabric in weights ranging from 20 oz to 96 oz. The thickness of the fabric is typically up to 1 inch thick. Perspective views of the three-dimensional configuration of the 3Weave products are depicted in FIGS. 1A and 1B. By way of example, the 50 oz 3WEAVE™ S-2 Glass has the following properties:

| Yarn Direction | Warp (x) | Weft (y) | Z yarn |
|---|---|---|---|
| Yarn Type | S-2 ® Glass Roving | S-2 ® Glass Roving | S-2 ® Glass Roving |
| Weight % | 46.7 | 46.7 | 6.6 |
| # of Layers | 1 | 2 | — |
| Aerial Weight | 49.5 oz/yd$^2$ | 1.68 kg/m$^2$ | 0.344 lb/ft$^2$ |
| Thickness | 0.054 in | 1.37 mm | — |

Figure 2A:
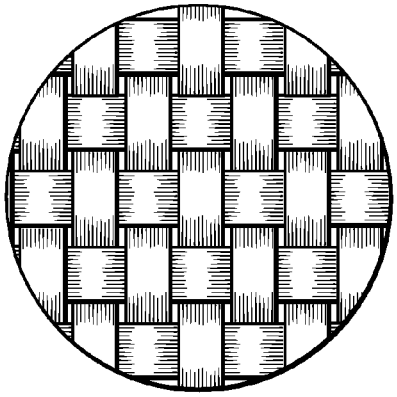
FIGS. 2A-2B depict types of exemplary weaves for two-dimensional woven fiberglass fabrics used in the present invention.
Figure 2B:
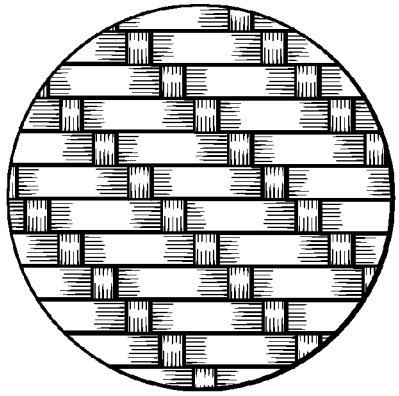

The two-dimensional weave fiberglass material may be a standard woven roving, for example, a 24 oz, 22 oz, or 18 oz fabric. E-Glass or S2-Glass may be used. Woven roving comes in various weights, and other weights than those mentioned are contemplated. The woven roving also comes in different two-dimensional weave patterns, including a basket weave shown in FIG. 2A and a twill weave shown in FIG. 2B. This material is manufactured both domestically and internationally by numerous manufacturers, including Fiber Glass Industries, Inc., BGF Industries, PPG Fiber Glass, Isorca, Ashland Chemical, Anhui Herrman Impex Co., Ltd., Danyang Zhongya Glass Fiber, Yangzhou Shuntong Imp/Exp Co., Ltd, and Saint Gobain Corp. An exemplary material is 24 oz ROVCLOTH® Super 317 E-Glass from Fiber Glass Industries, Inc.

The two types of fabric are then used to form a laminate composite together with the resin matrix. A plurality of the two-dimensional sheets are used, and a plurality of the three-dimensional sheets are used, with both types of fabric acting in concert and contributing to the ability of the laminate to capture piercing ammunition and prevent the ammunition from completely passing through the backside of the laminate. The total amount of resin used to manufacture a laminated composite armor structure depends on the size and total weight of the panel. In one embodiment of the invention, the total pounds of "resin to glass" may be about 1:3, or approximately 30%. As an example, a 100-pound Composite Armor panel may include 30-33 pounds of resin and 67-70 pounds of glass. In another embodiment, the total pounds of "resin to glass" may be about 1:5, or approximately 20%. Resin can be applied to the fabric sheets using a "hand lay-up" process or use of an automated impregnation system. Pre-pregnated fiberglass can also be utilized.

Figure 3:
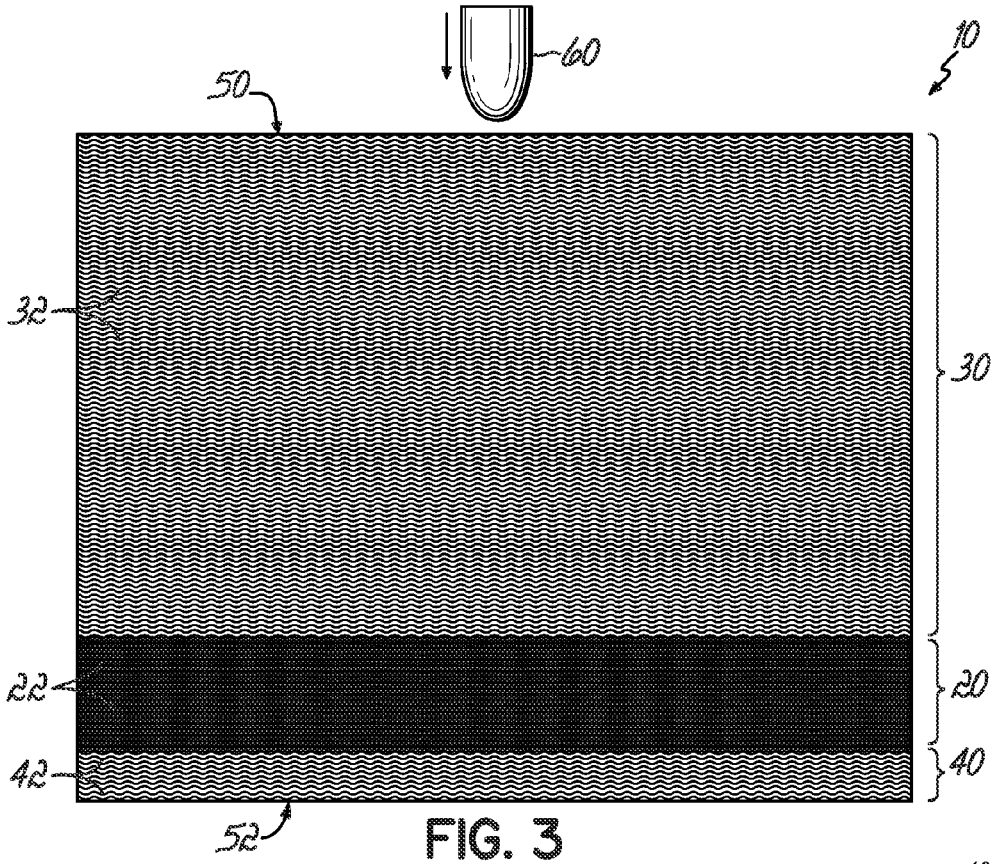
FIG. 3 is a side cross-sectional view of a composite laminated armor structure in accordance with one embodiment of the present invention.

In an exemplary embodiment depicted in side cross-sectional view in FIG. 3, a composite laminated armor structure 10 comprises a 3-D section 20 containing a plurality of three-dimensional fabric sheets 22 sandwiched between front and back 2-D sections 30 and 40, respectively, each containing a plurality of two-dimensional fabric sheets 32 and 42, respectively. Opposite the 3-D section 20, the 2-D section 30 forms the front face 50 of the composite laminated armor structure 10, or panel, where the ammunition or projectile 60 would first hit when the armor structure 10 is in use, while the back 2-D section 40 forms the back face 52 of the armor structure 10 where the ammunition 60 is prevented from passing completely through, in accordance with the invention. In a further exemplary embodiment, the front 2-D panel 30 includes at least twice as many sheets 32 of fabric as the 3-D section 20, and the 3-D section 20 includes more fabric sheets 22 than the back 2-D section 40. In another exemplary embodiment, the front 2-D panel 30 includes at least four times more fabric sheets 32 than the 3-D section 20, and the 3-D section 20 includes more fabric sheets 22 than the back 2-D section 40. In yet another exemplary embodiment, the 3-D section 20 includes twice as many fabric sheets 22 as the back 2-D section 40, and the front 2-D section 30 includes at least four times more fabric sheets 32 than the 3-D section 20. By way of example only, the back 2-D section 40 may include 3-20 fabric sheets 42, the 3-D section 20 may include 8-30 fabric sheets 22, and the front 2-D section 30 may include 50-175 fabric sheets 32. By way of additional example only, the back 2-D section 40 may include 4-12 fabric sheets 42, the 3-D section 20 may include 8-25 fabric sheets 22, and the front 2-D section 30 may include 75-150 fabric sheets 32.

The resin matrix is applied throughout the plurality of fabric sheets 22, 32, 42, such as by coating each fabric sheet, or by dipping the plurality of fabric sheets in a liquid resin bath to penetrate the composite and provide a binder matrix reinforced by the fiberglass. The resin may comprise 10-50 wt. % of the composite. In an exemplary embodiment, the resin comprises 20-40 wt. % of the composite. In a further exemplary embodiment, the resin comprises about 29-35 wt. % of the composite, or roughly ⅓ of the composite structure.

After the fabric sheets 22, 32, 42 are assembled with the resin, the structure is then pressed and molded. In an exemplary embodiment, the press is at least a 1,000 ton press. The structure is heated at a temperature of at least 300° F. to cure the resin. The temperature profile from the top to bottom of the mold may vary, for example, ±15° F. In an exemplary embodiment, the bottom of the press is no less than 295° F. and the top of the press is no less than 310° F. The structure may be pressed under 200 tons of pressure for 20 minutes, for example, and then decompressed for 20 minutes before being removed from the mold. In an exemplary embodiment, the structure is pressed under a pressure ranging from greater than 150 tons to less than 250 tons. After pressing, the composite laminated armor structure 10 may have a thickness on the order of 3 inches, for example.

Figure 4:
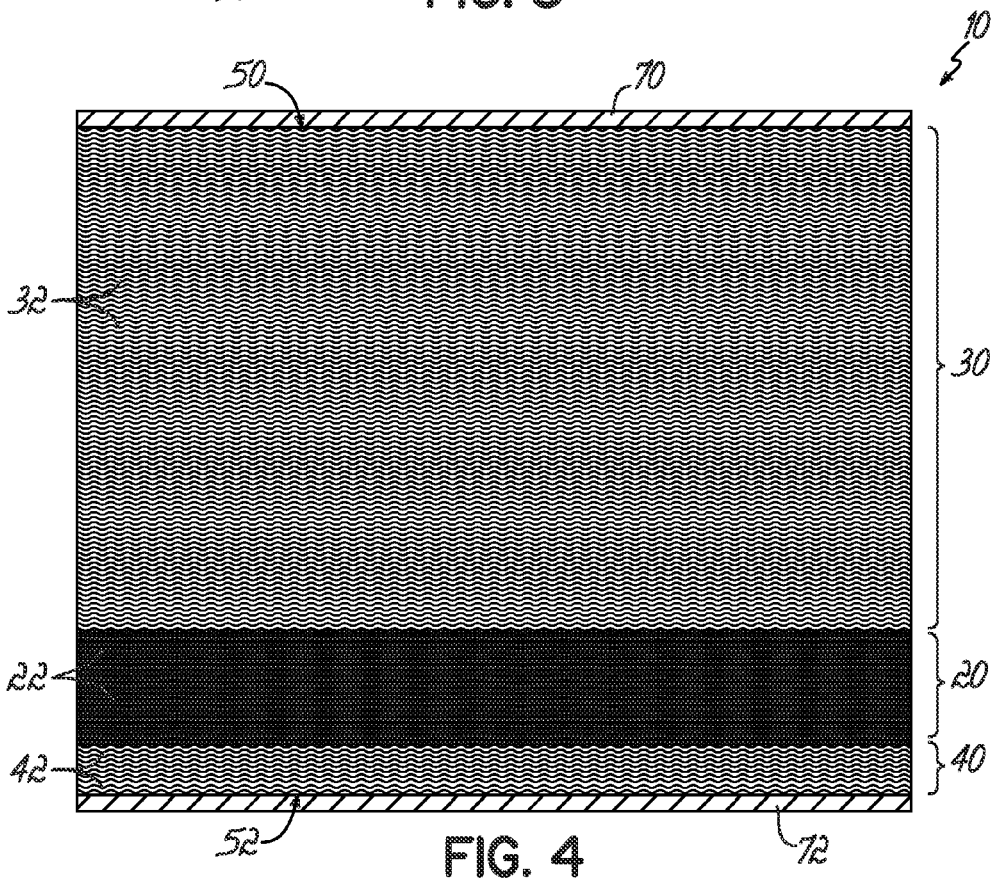
FIG. 4 is a side cross-sectional view of a composite laminated armor structure in accordance with another embodiment of the present invention.

In accordance with another embodiment of the invention, depicted in side cross-sectional view in FIG. 4, the addition of heat-treated metal alloy armor plates 70, 72 to the laminated armor structure 10 will increase the ballistic protection for high-strength applications, in particular 50 caliber AP ammunition and even ammunition as powerful as 25 mm caliber TP ammunition, which is more akin to a small rocket, and is the level or armament used on tanks. An armor plate 72 is added to at least the back face 52 of the laminated armor structure 10, adhered to the back 2-D section 40. In an exemplary embodiment, an armor plate 70 is also added to the front face 50 of the composite laminated armor structure 10, adhered to the front 2-D section 30. One suitable armor plate material is aluminum alloy Military Specification MIL-DTL-46063H, known as Aluminum Armor Plate or "Mil spec 46063," having the following general composition:

TABLE I

Chemical Composition

| Element | Percent |
|---|---|
| Zinc | 3.5-4.5 |
| Magnesium | 2.3-3.3 |
| Manganese | 0.10-0.40 |
| Copper | 0.10 max |
| Iron | 0.40 max |
| Silicon | 0.30 max |
| Chromium | 0.15-0.25 |
| Titanium | 0.10 max |
| Others, each | 0.05 max |
| Others, total | 0.15 max |
| Aluminum (by difference) | Remainder |

Another suitable armor plate material is AL 521 Monolithic Armor Plate from Allegheny Ludlum Corporation, Washington, Pa. AL 521 is a Ni—Cr—Mo alloy steel and is produced by electric arc furnace (EAF) melting plus argon oxygen decarburization (AOD) refining. The nominal composition is as follows:

TABLE II

Chemical Composition

| Element | Percent |
|---|---|
| Carbon | 0.28 |
| Manganese | 1.00 |
| Phosphorus | 0.025 max |
| Sulfur | 0.005 max |
| Silicon | 0.35 |
| Chromium | 1.75 |
| Nickel | 3.75 |
| Molybdenum | 0.30 |
| Iron (by difference) | Remainder |

Slabs are hot rolled to produce plates 3/16 inch to 1.50 inch thick. AL 521 plates are supplied in the air hardened condition. AL 521 meets the ballistic requirements of Mil-A-46100D even at 3/16 inch and ¼ inch thick, but it does not comply with the compositional or quench and temper requirements. AL 521 is a superior armor plate compared with high hard steel normally supplied per Mil-A-46100D due to its outstanding toughness and blast performance.

The thickness of the armor plates 70, 72 may vary as necessary, for example the plates 70, 72 may be about ⅛ inch up to about ¼ inch. A ¼-½ inch thickness for the Aluminum Armor Plate is exemplary, and a ⅛ to ½ inch thickness for the Monolithic Armor Plate is exemplary.

RESIN MATRIX EXAMPLE

In one example of the invention, the resin was a blend of six materials. A 100 lb batch of resin matrix material was made as follows:

(1) 60.54 pounds Aropol™ Q 6585 polyester thermosetting resin (2) 17.03 pounds Aropol™ Q8000 styrene-based thermoplastic resin (3) 2.23 pounds zinc stearate mold release agent (4) 0.58 pound SUPEROX® 46-736 organic peroxide curing agent (5) 19.46 pounds PUL-PRO® White 8-SA limestone filler (6) 0.16 pound pigment The six materials were mixed and heated to a temperature of between 90-95° F. The resin was then loaded into "production tanks" that were delivered to the production floor. The 6-component resin of this Resin Matrix Example is referred to herein as formula "4609".

LAMINATE STRUCTURE EXAMPLES

Example 1

A composite laminated armor structure of the invention was assembled as follows. The 4609 resin from the Resin Matrix Example above was extracted from the production tanks and weighed. In this example, the total pounds of "resin to glass" was approximately 30%.

First, resin was applied to six plys of 24 oz ROVCLOTH® Super 317 woven roving. Next, 12 plys of 3Tex 50 oz 3WEAVE™ S-2 Glass was applied over the six plys of 24 oz ROVCLOTH® Super 317 E-Glass woven roving, and the 4609 resin was applied between each ply or sheet. After six plys of woven roving and 12 Plys of the 50 oz 3Tex Fabric, approximately 124 additional plys of 24 oz ROVCLOTH® Super 317 was applied. The 4609 resin was applied between each of the 124 plys of woven roving.

After the 124 plys of woven roving, the material was then ready to be pressed. The press should be no less than a 1,000 ton press. The press was heated so that the top profile was no less than 310° F. and the bottom no less than 295° F. The "charge" was then loaded in the press and the press was closed. The press remained closed under 200 tons of pressure for 20 minutes, then was decompressed for 20 minutes. The press was then opened and the panel removed and weighed. This same assembly procedure was used in each of the examples recited below.

The panel constructed as set forth above may be effective at stopping certain types of AP ammunition, in particular, 30:06 AP ammunition and 30 caliber 762×51 AP ammunition (also referred to as 308 AP or AK 47 round), as well as smaller similar type AP rounds. The panel had a calculated aerial density on the order of 31 pounds per square foot (lbs/ft$^2$). It may be appreciated that the aerial densities set forth herein are calculated based upon the expected or stated weights of the various plies in the armor structures, but the actual measured value may vary in light of allowable manufacturing variations/tolerances in the various products supplied by various manufacturers that make up the armor structures of the invention.

Example 2

After the panel of Example 1 was cured, a ½ inch Mil spec 46063Aluminum Armor Plate was applied to both the front and back faces of the panel. This panel may be effective at stopping certain types of AP ammunition, in particular, 50 caliber AP ammunition. The panel had a calculated aerial density on the order of 45 lbs/ft$^2$.

Example 3

The following composite laminate formulation was assembled and may be capable of stopping the 762×51 caliber AP round and 30:06 AP round. A fiber reinforced resin composite panel was assembled, from the bottom up, as follows:

6 plys of 2-D 24 ounce woven roving as back 2-D section
8 plys of 3-D 3Tex 50 ounce S-2 glass as 3-D section
60 plys of 2-D 24 ounce woven roving as front 2-D section
30% Formula 4609 resin matrix The structure was pressed under 200 tons of pressure for 20 minutes and then decompressed for 20 minutes before being removed from the mold. After molding the panel, a ½ inch plate of Mil spec 46063 Aluminum Armor Plate was bonded to the back face of the panel. The armor structure had a calculated aerial density of about 23 lbs/ft$^2$. In an alternative embodiment, the aluminum plate could be bonded to the front face of the panel instead of the back face of the panel.

Example 4

The following composite laminate formulation was assembled and may be capable of stopping the 762×51 caliber AP round and 30:06 AP round. A fiber reinforced resin composite panel was assembled, from the bottom up, as follows:

6 plys of 2-D 24 ounce woven roving as back 2-D section
12 plys of 3-D 3Tex 50 ounce S-2 glass as 3-D section
80 plys of 2-D 24 ounce woven roving as front 2-D section
30% Formula 4609 resin matrix The structure was pressed under 200 tons of pressure for 20 minutes and then decompressed for 20 minutes before being removed from the mold. After molding the panel, a ½ inch plate of Mil spec 46063 Aluminum Armor Plate was bonded to the back face of the panel. The armor structure had a calculated aerial density of about 30 lbs/ft$^2$. In an alternative embodiment, the aluminum plate could be bonded to the front face of the panel instead of the back face of the panel.

Example 5

The following composite laminate formulation was assembled and may be capable of stopping the 50 caliber AP round. A fiber reinforced resin composite panel was assembled, from the bottom up, as follows:

6 plys of 2-D 24 ounce woven roving as back 2-D section
12 plys of 3-D 3Tex 50 ounce S-2 glass as 3-D section
80 plys of 2-D 24 ounce woven roving as front 2-D section
30% Formula 4609 resin matrix The structure was pressed under 200 tons of pressure for 20 minutes and then decompressed for 20 minutes before being removed from the mold. After molding the panel, a ½ inch plate of Mil spec 46063 Aluminum Armor Plate was bonded to both the front and back faces of the panel. The armor structure had a calculated aerial density of about 35.5 lbs/ft$^2$.

Example 6

The following composite laminate formulation was assembled and may be capable of stopping the 50 caliber AP round. A fiber reinforced resin composite panel was assembled, from the bottom up, as follows:

6 plys of 2-D 24 ounce woven roving as back 2-D section
12 plys of 3-D 3Tex 50 ounce S-2 glass as 3-D section
124 plys of 2-D 24 ounce woven roving as front 2-D section
30% Formula 4609 resin matrix The structure was pressed under 200 tons of pressure for 20 minutes and then decompressed for 20 minutes before being removed from the mold. After molding the panel, a ½ inch plate of Mil spec 46063 Aluminum Armor Plate was bonded to the back face of the panel. The armor structure had a calculated aerial density of about 38 lbs/ft$^2$.

Example 7

The following composite laminate formulation was assembled and may be capable of stopping a 25 mm TP round. A fiber reinforced resin composite panel was assembled, from the bottom up, as follows:

6 plys of 2-D 24 ounce woven roving as back 2-D section
20 plys of 3-D 3Tex 50 ounce S-2 glass as 3-D section
140 plys of 2-D 24 ounce woven roving as front 2-D section
30% Formula 4609 resin matrix The structure was pressed under 200 tons of pressure for 20 minutes and then decompressed for 20 minutes before being removed from the mold. After molding the panel, a ½ inch plate of Mil spec 46063 Aluminum Armor Plate was bonded to both the front and back faces of the panel. The armor structure had a calculated aerial density of about 51 lbs/ft$^2$.

Example 8

The following composite laminate formulation was assembled and may be capable of stopping a 25 mm TP round. A fiber reinforced resin composite panel was assembled, from the bottom up, as follows:

10 plys of 2-D 24 ounce woven roving as back 2-D section
20 plys of 3-D 3Tex 50 ounce S-2 glass as 3-D section
140 plys of 2-D 24 ounce woven roving as front 2-D section
30% Formula 4609 resin matrix The structure was pressed under 200 tons of pressure for 20 minutes and then decompressed for 20 minutes before being removed from the mold. After molding the panel, a ½ inch plate of Mil spec 46063 Aluminum Armor Plate was bonded to both the front and back faces of the panel. The armor structure had a calculated aerial density of about 52 lbs/ft$^2$.

Example 9

The following composite laminate formulation was assembled and may be capable of stopping a 25 mm TP round. A fiber reinforced resin composite panel was assembled, from the bottom up, as follows:

10 plys of 2-D 24 ounce woven roving as back 2-D section 18 plys of 3-D 3Tex 50 ounce S-2 glass as 3-D section 120 plys of 2-D 24 ounce woven roving as front 2-D section 30% Formula 4609 resin matrix The structure was pressed under 200 tons of pressure for 20 minutes and then decompressed for 20 minutes before being removed from the mold. After molding the panel, a ½ inch plate of Mil spec 46063 Aluminum Armor Plate was bonded to both the front and back faces of the panel. The armor structure had a calculated aerial density of about 47 lbs/ft$^2$.

Example 10

The following composite laminate formulation was assembled and may be capable of stopping a 25 mm TP round. A fiber reinforced resin composite panel was assembled, from the bottom up, as follows:

6 plys of 2-D 24 ounce woven roving as back 2-D section 8 plys of 3-D 3Tex 50 ounce S-2 glass as 3-D section 124 plys of 2-D 24 ounce woven roving as front 2-D section 30% Formula 4609 resin matrix The structure was pressed under 200 tons of pressure for 20 minutes and then decompressed for 20 minutes before being removed from the mold. After molding the panel, a ½ inch plate of Mil spec 46063 Aluminum Armor Plate was bonded to both the front and back faces of the panel. The armor structure had a calculated aerial density of about 43 lbs/ft$^2$.

Example 11

The following composite laminate formulation was assembled and may be capable of stopping the 25 mm TP round, 30:06 AP round and 762×51 caliber AP round. A fiber reinforced resin composite panel was assembled, from the bottom up, as follows:

6 plys of 2-D 24 ounce woven roving as back 2-D section 12 plys of 3-D 3Tex 50 ounce S-2 glass as 3-D section 120 plys of 2-D 24 ounce woven roving as front 2-D section 20% Formula 4609 resin matrix The structure was pressed under 200 tons of pressure for 20 minutes and then decompressed for 20 minutes before being removed from the mold. After molding the panel, a 3/16 inch plate of AL 521 Monolithic Armor Plate was bonded to both the front and back faces of the panel. The armor structure had a calculated aerial density of about 48 lbs/ft$^2$.

Example 12

The following composite laminate formulation was assembled and may be capable of stopping the 50 caliber AP round, 30:06 AP round and 762×51 caliber AP round. A fiber reinforced resin composite panel was assembled, from the bottom up, as follows:

6 plys of 2-D 24 ounce woven roving as back 2-D section 12 plys of 3-D 3Tex 50 ounce S-2 glass as 3-D section 80 plys of 2-D 24 ounce woven roving as front 2-D section 20% Formula 4609 resin matrix The structure was pressed under 200 tons of pressure for 20 minutes and then decompressed for 20 minutes before being removed from the mold. After molding the panel, a 3/16 inch plate of AL 521 Monolithic Armor Plate was bonded to both the front and back faces of the panel. The armor structure had a calculated aerial density of about 40 lbs/ft$^2$.

Example 13

The following composite laminate formulation was assembled and may be capable of stopping the 50 caliber AP round, 762×51 caliber AP round and 30:06 AP round. A fiber reinforced resin composite panel was assembled, from the bottom up, as follows:

6 plys of 2-D 24 ounce woven roving as back 2-D section 8 plys of 3-D 3Tex 50 ounce S-2 glass as 3-D section 80 plys of 2-D 24 ounce woven roving as front 2-D section 20% Formula 4609 resin matrix The structure was pressed under 200 tons of pressure for 20 minutes and then decompressed for 20 minutes before being removed from the mold. After molding the panel, a 3/16 inch plate of AL 521 Monolithic Armor Plate was bonded to both the front and back faces of the panel. The armor structure had a calculated aerial density of about 36 lbs/ft$^2$.

Example 14

The following composite laminate formulation was assembled and may be capable of stopping the 50 caliber AP round, 762×51 caliber AP round and 30:06 AP round. A fiber reinforced resin composite panel was assembled, from the bottom up, as follows:

6 plys of 2-D 24 ounce woven roving as back 2-D section 8 plys of 3-D 3Tex 50 ounce S-2 glass as 3-D section 60 plys of 2-D 24 ounce woven roving as front 2-D section 20% Formula 4609 resin matrix The structure was pressed under 200 tons of pressure for 20 minutes and then decompressed for 20 minutes before being removed from the mold. After molding the panel, a 3/16 inch plate of AL 521 Monolithic Armor Plate was bonded to both the front and back faces of the panel. The armor structure had a calculated aerial density of about 32 lbs/ft$^2$.

Example 15

The following composite laminate formulation was assembled and may be capable of stopping the 762×51 caliber AP round. A fiber reinforced resin composite panel was assembled, from the bottom up, as follows:

6 plys of 2-D 24 ounce woven roving as back 2-D section 8 plys of 3-D 3Tex 50 ounce S-2 glass as 3-D section 20 plys of 2-D 24 ounce woven roving as front 2-D section 20% Formula 4609 resin matrix The structure was pressed under 200 tons of pressure for 20 minutes and then decompressed for 20 minutes before being removed from the mold. After molding the panel, a 3/16 inch plate of AL 521 Monolithic Armor Plate was bonded to both the front and back faces of the panel. The armor structure had a calculated aerial density of about 25 lbs/ft$^2$.

Testing

The following is test data for the 30 caliber 762×51 AP ammunition using the embodiment of Example 1, wherein the panel had a calculated aerial density of about 31 lb/ft$^2$:

| | |
|---|---|
| Test Panel ID: 150 (36" × 23.5", thickness 3") | Panel Weight: 162 lbs |
| Type: Glass reinforced polyester composite door | Aerial Density: 0.036 lbs/ft sq |
| Projectile Caliber: 7.62 mm (0.308 cal) | Projectile Type: M61 AP |

| Shot Number | Projectile Grains | Propellant Grains | Strike Velocity ft/sec | Penetration Yes/No |
|---|---|---|---|---|
| 1 | 151.04 | 42.00 | 2587.1 | No |
| 2 | 151.00 | 43.00 | 2645.6 | No |
| 3 | 149.82 | 43.50 | 2698.9 | No |
| 4 | 149.90 | 45.81 | 2824.4 | Yes |
| 5 | 150.92 | 45.81 | 2849.7 | Yes |
| 6 | 151.45 | 45.81 | 2809.5 | Yes |
| 7 | 150.80 | 45.00 | 2766.0 | No |
| 8 | 151.08 | 44.19 | 2677.4 | No |
| 9 | 149.80 | 45.00 | 2754.9 | No |
| 10 | 150.20 | 45.07 | 2773.8 | No |
| 11 | | Full | 2690.9 | No |
| 12 | 151.90 | 45.00 | 2770.5 | No |
| Calculated $V_{50}$: 2796.4 fps | | | Extreme Spread: 94.8 fps | |

The following is test data from two different test runs for the 50 caliber AP ammunition using the embodiment of Example 5, wherein the panels each had a calculated aerial density of 34 lb/ft$^2$:

Test Panel ID: #158-5
Type: Glass reinforced polyester with ballistic aluminum, front & back
Projectile Caliber: 0.50 cal — Projectile Type: M2 AP
Propellant Type: Ball Propellant

| Shot Number | Projectile Grains | Propellant Grains | Strike Velocity ft/sec | Penetration Yes/No |
|---|---|---|---|---|
| 1 | 693.44 | 169.36 | 2323.9 | No |
| 2 | 694.50 | 187.86 | 2420.7 | No |
| 3 | 696.98 | 203.16 | 2604.8 | Yes |
| 4 | 696.52 | 198.66 | 2594.0 | Yes |
| 5 | 699.24 | 194.66 | 2534.0 | Yes |
| 6 | 692.98 | 191.66 | 2401.4 | No |
| 7 | 692.98 | 191.66 | 2409.5 | Yes |
| 8 | 697.64 | 191.66 | 2464.8 | Yes |
| | | $V_{50}$ | 2425.7 | |

Test Panel ID: #158-4
Type: Glass reinforced polyester with ballistic aluminum, front & back
Projectile Caliber: 0.50 cal — Panel Weight: 208 lbs
Propellant Type: Ball Propellant — Projectile Type: M2 AP

| Shot Number | Projectile Grains | Propellant Grains | Strike Velocity ft/sec | Penetration Yes/No |
|---|---|---|---|---|
| 1 | 694.14 | 169.16 | 2287.0 | No |
| 2 | 694.26 | 184.66 | 2228.9 | No |
| 3 | 694.68 | 203.16 | 2532.1 | Yes |
| 4 | 695.34 | 203.16 | 2555.3 | Yes |
| 5 | 695.34 | 200.16 | 2484.9 | Yes |
| 6 | 693.22 | 196.66 | 2443.6 | Yes |
| 7 | 693.58 | 193.66 | 2536.0 | No |
| 8 | 693.24 | 193.66 | 2480.6 | Yes |
| 9 | 698.26 | 190.16 | 2296.0 | No |
| 10 | 693.58 | 190.66 | 2518.7 | Yes |
| 11 | 695.64 | 189.66 | 2490.5 | Yes |

The following is test data for the 25 mm caliber AP and TP ammunition using the embodiments of Examples 5, 8, 9 and 10:

Live Fire Panel

Penetration 25 mm Test

A Live Fire penetration test was conducted on composite panels #158-3, #155, #156 and #157. The Panels were installed in a holding fixture approximately 130 feet from the muzzle. The Test consisted of firing 25 mm AP or TP rounds at the Test panels. In this test, the only data collected was whether the projectile penetrated or not. The outcome of the Test is listed below.

| Panel ID No. | Width | Type of 25 mm Round | Penetration |
|---|---|---|---|
| #156 | 4¾" | TP M793 | No |
| #157 | 4⅜" | AP M791 | Yes |
| #158-3 | 3⅜" | AP M791 | Yes |
| #155 | 3⅜" | TP M793 | Yes |

Comparing Panel #155 (Embodiment of Example 10) to #156 (Embodiment of Example 9), when the thickness of the panel is increased and more 3-D layers are used in the structure, the panel can stop the ball-round equivalent. This illustrates the ability to scale the panels by determining through routine experimentation the number of layers in each of the 2-D and 3-D sections needed to stop the anticipated threat level. However, even more scaling may be necessary to stop an AP ammunition threat. Panel #157 (Embodiment of Example 8) and panel #158-3 (Embodiment of Example 5) were not thick enough to stop the AP rounds, and so one or more of the 2-D and/or 3-D sections may need scaled up and/or the overall thickness of the structure increased, and/or the armor panel thickness increased to stop the 25 mm AP threat.

The armor panel of Example 15 was used to fabricate a door for a military Humvee vehicle. The armor panel was 1⅜ inch thick. Using 762×51 caliber AP round, 70 shots were fired at the door from a distance of 42 feet, with zero degrees of obliquity. The muzzle velocity was 2800-2850 ft/sec and the strike velocity was 2750-2800 ft/sec. Not a single round penetrated the armor panel of the invention, i.e., not a single round passed through the back of the panel.

As referred to above, the composite laminate armor structure of the invention is scalable, meaning that the number of layers in each section (2-D back, 2-D front and 3-D) and the use of armor plates and the type and thicknesses thereof can be adjusted to stop multiple threat levels. In addition, the armor structure of the invention is considerably lighter than present armor materials used for military vehicles and tanks, for example. In addition, the material is significantly less expensive than the current armor materials. By way of example, an armor panel for the door of a military Humvee may currently weigh on the order of 450 pounds. A panel of the present invention weighing 200 pounds or less can do the same job, or better. As another example, a composite laminate panel of the invention including front and back armor plates and weighing 20% of the weight of current tank material was capable of stopping a 25 mm round shot from a cannon from 50 ft at a velocity of 3800 ft/sec. Thus, the present invention provides the potential to reduce the weight of military vehicles significantly while increasing the ability to stop AP and/or TP ammunition.

Of course, military vehicles are but one potential use for the armor material of the invention. The following is a list of potential uses for the armor structures of the invention, but is by no means exhaustive:

Military or civilian vehicle components may include the following vehicle parts: firewall, front and rear floor boards, doors, roof, hood, rear deck, side panels, structure/frame/A&B pillars, seats, tailgate, walls for slide-in troop carrier, etc.

Non-vehicle security applications may include the following: safe houses, safe rooms, guard shacks, checkpoint shields, bomb transport containers, safes, vaults, money carriers, etc.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope of the general inventive concept.

What is claimed is:

1. A composite laminated armor structure for absorbing and dissipating kinetic energy from a projectile fired at the armor structure, comprising a plurality of sheets of two-dimensional woven fiberglass fabric, and a plurality of sheets of three-dimensional woven fiberglass fabric, bound with a resin matrix, wherein the two-dimensional woven fiberglass fabric is woven in only the x and y directions, and wherein the three-dimensional woven fiberglass fabric is woven in all of x, y, and z directions.

2. The armor structure of claim 1 further comprising a metal alloy armor plate adhered to a front outer surface and positioned to receive an initial impact from a projectile.

3. The armor structure of claim 1 further comprising a metal alloy armor plate adhered to a back outer surface and positioned to prevent penetration of a projectile completely through the armor structure.

4. The armor structure of claim 1 wherein the resin matrix comprises a polyester resin.

5. The armor structure of claim 4 wherein the resin matrix further comprises a styrene.

6. The armor structure of claim 1 wherein the resin is present in an amount of 10-50 wt. % of the armor structure.

7. The armor structure of claim 1 wherein the resin is present in an amount of 29-35 wt. % of the armor structure.

8. The armor structure of claim 1 wherein the plurality of sheets of three-dimensional woven fiberglass fabric are sandwiched between the plurality of sheets of two-dimensional woven fiberglass fabric.

9. The armor structure of claim 1 wherein the plurality of sheets of three-dimensional woven fiberglass fabric comprises 8-30 sheets.

10. A composite laminated armor structure for absorbing and dissipating kinetic energy from a projectile fired at the armor structure, comprising:

a back laminate section comprising a plurality of first sheets of two-dimensional woven fiberglass fabric bound with a resin matrix;

a front laminate section comprising a plurality of second sheets of two-dimensional woven fiberglass fabric bound with the resin matrix;

an intermediate section interposed between the front and back laminate sections and comprising a plurality of sheets of three-dimensional woven fiberglass fabric bound with the resin matrix;

a first metal alloy armor plate adhered to the back laminate section in opposing relation to the intermediate section; and a second metal alloy armor plate adhered to the front laminate section in opposing relation to the intermediate section, wherein the two-dimensional woven fiberglass fabric is woven in only the x and y directions, and wherein the three-dimensional woven fiberglass fabric is woven in all of x, y, and z directions.

11. The armor structure of claim 10 wherein the resin matrix comprises a blend of polyester resin and styrene.

12. The armor structure of claim 10 wherein the resin is present in an amount of 10-50 wt. % of the armor structure.

13. The armor structure of claim 10 wherein the resin is present in an amount of 29-35 wt. % of the armor structure.

14. The armor structure of claim 10 wherein the intermediate section comprises 8-30 sheets of three-dimensional woven fiberglass fabric.

15. The armor structure of claim 10 wherein the back laminate section comprises 3-20 first sheets of two-dimensional woven fiberglass fabric.

16. The armor structure of claim 10 wherein the front laminate section comprises 50-175 second sheets of two-dimensional woven fiberglass fabric.

17. The armor structure of claim 10 wherein the intermediate section comprises more sheets than the back laminate section.

18. The armor structure of claim 17 wherein the front laminate section comprises at least four times more sheets than the intermediate section.

19. The armor structure of claim 10 wherein the back laminate section comprises 3-20 first sheets of two-dimensional woven fiberglass fabric, the intermediate section comprises 8-30 sheets of three-dimensional woven fiberglass fabric, and the front laminate section comprises 50-175 second sheets of two-dimensional woven fiberglass fabric.

20. The armor structure of claim 10 further comprising a first metal alloy armor plate adhered to the back laminate section in opposing relation to the intermediate section.

21. The armor structure of claim 20 further comprising a second metal alloy armor plate adhered to the front laminate section in opposing relation to the intermediate section.

22. The armor structure of claim 21 wherein the first and second metal alloy armor plates comprise a Ni—Cr—Mo alloy steel.

23. The armor structure of claim 21 wherein the first and second metal alloy armor plates have a thickness of 3/16 inch.

* * * * *